United States Patent [19]

Smith et al.

[11] Patent Number: 4,525,291

[45] **Date of Patent: * Jun. 25, 1985**

[54] LIQUID DETERGENT COMPOSITIONS

[75] Inventors: Eileen Smith, Chester; Doreen A. Timperley, Widnes; Dorothy M. Titchener, Chester, all of England

[73] Assignee: Interox Chemicals Limited, London, England

[ * ] Notice: The portion of the term of this patent subsequent to Aug. 31, 1999 has been disclaimed.

[21] Appl. No.: 351,331

[22] Filed: Feb. 22, 1982

Related U.S. Application Data

[63] Continuation-in-part of Ser. No. 245,141, Mar. 18, 1981, abandoned.

[30] Foreign Application Priority Data

Apr. 1, 1980 [GB] United Kingdom ..... 8010885
Apr. 1, 1980 [GB] United Kingdom ..... 8010887
Sep. 30, 1981 [GB] United Kingdom ..... 8129512

[51] Int. Cl.[3] ..... C11D 7/54

[52] U.S. Cl. ..... 252/95; 252/99; 252/104; 252/186.29; 252/186.43; 252/400 A; 252/407

[58] Field of Search ..... 252/95, 99, 104, 186, 252/400 A, 407, 186.43, 186.41, 186.28, 186.29

[56] References Cited

U.S. PATENT DOCUMENTS 3,130,164 4/1964 Best ..... 252/99
3,686,126 8/1972 Smeets ..... 252/99
3,789,002 1/1974 Weber et al. ..... 252/99
3,860,391 1/1975 Kling et al. ..... 162/76 X
4,059,678 11/1977 Winkley ..... 252/86 X
4,304,762 12/1981 Leigh ..... 423/272
4,347,149 8/1982 Smith et al. ..... 252/102

FOREIGN PATENT DOCUMENTS 1446971 8/1976 United Kingdom .

*Primary Examiner*—Michael R. Lusignan
*Attorney, Agent, or Firm*—Larson and Taylor

[57] ABSTRACT

The present invention relates to aqueous alkaline built detergent compositions containing hydrogen peroxide. Alkaline conditions present particular difficulties for preventing the hydrogen peroxide from decomposing excessively rapidly during storage. Aqueous compositions containing a builder, especially polyphosphate or citrate, anionic sulphate or sulphonate surfactant, nonionic ethoxylate surfactant and hydrogen peroxide of acceptable peroxide stability can be obtained by employing an alcohol, preferably ethanol or isopropanol, or a polyhydroxy carboxylate, preferably gluconate, or especially both, in conjunction with a phosphonate, especially an ethylene amine methylene phosphonate. Many of such alkaline compositions are formulated to permit the anionic surfactant to work at or near to its optimum pH in conjunction with the builder. The invention also provides similar, but unbuilt compositions containing instead of the builder, additional surfactant, generally nonionic surfactant, and having a somewhat lower pH.

41 Claims, No Drawings

LIQUID DETERGENT COMPOSITIONS

This application is a continuation-in-part of co-pending application Ser. No. 245,141 filed Mar. 18, 1981, now abandoned.

The present invention relates to liquid detergent compositions and more particularly to built liquid detergents compositions containing an active oxygen-containing compound.

For many years, many solid heavy duty washing compositions have contained one or more active oxygen-containing compounds (sometimes called per-compounds or peroxygen compounds) in order to oxidise and de-colourise various stains commonly encountered in household laundry, and to thereby complement the other components of the washing composition. However, it has been recognised that even in such solid compositions where the active oxygen-containing compounds and the alkaline components of the washing composition are both in solid form, there is a tendency for the activity of the active oxygen-containing compound to diminish during storage of the washing composition, on account of interaction of the percompound with the alkaline components and water vapour in the air surrounding the composition. The rate of loss of activity of the solid active oxygen-containing compound can be significantly reduced to acceptable levels by contacting the compound with various peroxygen compound stabilisers, of which a particularly appropriate sort comprises alkali or alkaline earth metal silicates, as described for example in GBPS No. 1,553,505 to Interox Chemicals Ltd, and alternatively or additionally coating the solid particles of the compound with a suitable organic or inorganic barrier to prevent the compound coming into contact with the other components of the washing composition. Examples of compositions stabilised by coating are described in U.S. Pat. No. 3,847,830 assigned to Laporte Industries Limited and U.S. Pat. No. 3,992,317 and U.S. Pat. No. 4,105,827, both assigned to Interox S.A.

Examination of the prior art demonstrates a marked reluctance on the part of producers of detergent compositions to employ built aqueous alkaline liquid detergent compositions containing a peroxygen compound. For example, U.S. Pat. No. 3,850,831 assigned to Mo Och Domsjo Aktiebolag deliberately employs non-aqueous compositions instead of aqueous compositions because they were unable to prevent rapid decomposition of the peroxygen compound during storage of the aqueous composition. In U.S. Pat. No. 3,852,210, assigned to Flow Pharmaceuticals Inc., the liquid detergent composition described was builder-free, and its pH was adjusted by addition of acid to pH 4 in the example in which the stability of that composition was tested. More recently, in U.S. Pat. No. 4,166,794, assigned to Colgate-Palmolive liquid bleach-softener compositions containing hydrogen peroxide were described, but such compositions contained cationic compounds instead of anionic surfactants, did not include a builder and their pH was adjusted to pH 4 to 5.

It is not surprising that the prior art sought ways to side-step the problems of providing a storage-stable heavy duty alkaline liquid detergent compositions containing an active oxygen-containing compound such as hydrogen peroxide, because the problems are much greater than for solid compositions. By virtue of the fact that all the components are in the liquid phase, they are inevitably always in intimate contact with each other and cannot be separated from the others simply by a coating technique. This would not matter if the other components in combination were compatible with hydrogen peroxide, but in practice this is not the case. Two of the main contributors to hydrogen peroxide instability are anionic surfactants and builders such as polyphosphate which are both time-honoured, readily available and cost effective components of washing compositions, but which generate mildly alkaline conditions in an aqueous concentrate, often from pH 8.5 to 9.5 when present in the ranges of concentrations suitable for a detergent concentrate. The instability of hydrogen peroxide under such conditions can be seen from the following results. A solution of 10 percent tetra-potassium pyrophosphate and 5 percent hydrogen peroxide in demineralized water lost 62 percent of the available oxygen (activity of the active oxygen-containing compound) within a fortnight and a similar composition containing the corresponding sodium salt lost 44 percent within a week.

The significance of this becomes more plain when it is recalled that pyrophosphate in low concentrations, and especially under acidic conditions, is employed as a stabilizer for hydrogen peroxide. It will, thus, be recognised that the problem of providing a storage stable aqueous alkaline detergent composition and especially a built detergent composition presents difficulties that are peculiar to such compositions.

It has also been suggested that detergent compositions can include organic complexing agents as builders. When small amounts of organic complexing agents, such as about 1 percent by weight were tested at 32° C. for long-term storage compatibility with hydrogen peroxide under mildly alkaline conditions, the result was, in general, an unacceptable loss of peroxidic activity. For example, an aqueous hydrogen peroxide solution containing 1 percent of ethylenediamine tetraacetic acid, tetra sodium salt lost a remarkable 96 percent within two weeks and that containing 1 percent of nitrilotriacetic acid, trisodium salt lost an incredible 79 percent in one week. A solution of hydrogen peroxide containing 1.3 percent of ethylene diamine tetra(methylene phosphonic acid), potassium salt lost 50 percent within a week. Clearly, the aforementioned results demonstrate that in such compositions the hydrogen peroxide is not storage stable under such alkaline conditions. Moreover, when alkali metal silicates which act as stabilisers for solid percompounds are introduced even at 1% into stabilised alkaline detergent compositions described hereinafter a more rapid loss of available oxygen occurs. Therefore, the need for a storage-stabilised aqueous alkaline detergent composition is still to be satisfied.

There is a further complicating factor to be borne in mind when considering the feasibility of producing a useful liquid detergent composition that is stabilised against loss of peroxide activity. When such liquid compositions are used for laundering, their primary use, they are merely diluted so that there is no change in the physical state of the composition such as occurs when a solid composition is dissolved. Hence, those compounds which are included in the concentrated detergent composition to prevent interaction of the peroxide with other components during storage inevitably are still present in the wash solution in the same weight ratio to the peroxide and with continuing capability to prevent interaction. It would therefore be expected that if a high ratio of stabiliser to peroxide is employed in order to obtain a mix of improved storage stability, the rate and extent of utilisation of the peroxide would be impaired, which would manifest itself in impaired washing performance.

It is an object of the present invention to provide an liquid detergent composition in a concentrated form which can be diluted to form a washing and laundering solution.

It is a further object of some embodiments of the present invention to provide aqueous alkaline detergent compositions containing a builder and hydrogen peroxide stabilised sufficently to avoid the use of special vented containers.

It is a still further object of certain embodiments of the present invention to provide aqueous alkaline detergent compositions containing a builder and hydrogen peroxide stabilised against excessive decomposition during storage, which provide a washing performance substantially the same as for the corresponding unstabilised composition.

According to the present invention there is provided a stabilised aqueous built liquid detergent composition comprising at least 4% of an anionic sulphate or sulphonate surfactant and/or of a non-ionic ethoxylate surfactant, at least 5% of a builder selected from alkali metal polyphosphates, and carboxylic acid complexing builders, at least 2% hydrogen peroxide, sufficient alkali metal aryl sulphonate hydrotrope to maintain the composition in a single phase, either by itself or in conjunction with other components, and a stabilising amount of a combination comprising a low molecular weight mono-hydroxy aliphatic alcohol, and/or a polyhydroxy aliphatic carboxylate and an aminomethylene phosphonate or hydroxy alkyl diphosphonate. Percentages for any component herein are by weight, based on the composition, unless specifically stated to the contrary.

The anionic surfactant, especially suitably, is an alkyl aryl sulphonate and in order to assist its biodegradability is preferably a linear alkyl aryl sulphonate. The alkyl group preferably contains from 9 to 18 carbon atoms, particularly the decyl, dodecyl or tetradecyl groups. Although other aryl groups can be used, the aryl group is normally benzene. Examples of suitable commercially available alkali metal alkyl aryl sulphonates are available under the trade names WARCODET K54 from Warwick Chemicals, England, NANSA SS60 from Albright and Wilson, England and especially HETSULF 60S from Heterene Chemicals Co, New Jersey. Other anionic surfactants that demonstrate compatability with hydrogen peroxide include alkyl sulphosuccinamate, the alkyl group preferably containing from 12 to 18 carbon atoms. A commercially available example of such a compound is ALCOPOL FA from Allied Colloids, England. Suitable anionic sulphate surfactants include primary alcohol sulphates and primary alcohol ether sulphates, the alkyl group in the alcohol moiety of such compounds normally containing from 9 to 18 and frequently from 12 to 15 carbon atoms. Commercially available examples of such compounds include PERLANKROL D.S.A., E.S.D. and E.A.D. being respectively a sodium primary alcohol sulphate, sodium primary alcohol ether sulphate, and ammonium primary alcohol ether sulphate, all available from Diamond Shamrock. Other useable sulphonate surfactants include n-alkane and olefin sulphonates, the aliphatic moiety normally containing at least 12 and often from 13 to 18 carbon atoms. Examples of such compounds are available under the trade name HOSTAPUR S.A.S. and O.S. from Hoechst (UK). Mixtures of any two or more of the foregoing anionic surfactants can be employed. Generally the concentrate contains at least 3% of the anionic sulphate and/or sulphonate surfactant and usually not more than 15%.

In many embodiments of the present invention, the non-ionic surfactant component of the composition is selected from primary alcohol ethoxylates and linear secondary alcohol ethoxylates. The alcohol component in each of these compounds preferably has a carbon chain length of R in the general formula $RO(C_2H_4O)_nH$ of at least 9 and frequently not more than 18 carbon atoms extending away from the ethoxylate moiety. In many commercially available compounds, the linear carbon chain of R is in the range of from 11 to 16 carbon atoms and in many cases the surfactant is derived from a mixture of alcohols.

In the ethoxylate moiety of such compounds, the degree of ethoxylation n is generally in the range of from 5 to 20 and in many very desirable ethoxylates, n is from 7 to 12. However, it is desirable also to take into account the relative proportions of the two moieties in the non-ionic surfactant involved, and this is often expressed in terms of the weight proportion of the ethoxylate moiety in the molecule. The proportion is desirably at least 50%, normally not more than 85% and preferably at least 60% up to 80%. A most desirable range of surfactants contains from 60 to 80%, preferably 65 to 75% by weight of the ethoxylate moiety and the alcohol moiety is a linear $C_{12}$, $C_{13}$, $C_{14}$, $C_{15}$ or $C_{16}$ or a mixture of linear alcohols having an average carbon chain length within the range of 12 to 16. It will be recognised that in many preferred alcohol ethoxylates, the ratio of the number of carbon atoms in R to the degree of ethoxylation n in the ethoxylate moiety is generally in the range of from 3:2 to 2:1. Examples of suitable commercially available alcohol ethoxylates are available under the tradenames SYNPERONIC A.7, A.9, and A.11, all from I.C.I., England, in which R is a mixture of $C_{13}$ and $C_{15}$ and the degree of ethoxylation are respectively 7, 9 and 11 TERGITOL 15-S-9 and 15-S-12, from Union Carbide, U.S.A., being $C_{11-15}$ linear secondary alcohol ethoxylates, having degrees of ethoxylation of respectively 9 and 12, LUBROL 12 A.9 and 17 A.10 from I.C.I., England, the average chain lengths of R being respectively 12 and 17 and the degrees of ethoxylation 9.5 and 10 ETHYLAN CD9112 and D259, both from Diamond Shamrock, and BRIJ 35, 78 and 98, being respectively the lauryl, stearyl and oleyl ethers of polyoxyethylenes and RENEX 20 being a polyoxyethylene mixed fatty acid ester available from Honeywell Atlas. A further polyethylene oxide condensate that can be employed is available under the trade name MYKON 100 from Warwick Chemicals. Mixtures of two or more ethoxylated surfactants can be used. The amount of non ionic surfactant used is normally at least 3% and frequently not more than 15%.

A third essential component of the built liquid detergent composition of the present invention is a builder selected from polyphosphate and carboxylic acid complexing builders. Amongst the polyphosphates, it is especially suitable to employ pyrophosphates, and more particularly the tetra potassium or tetra sodium salts or mixtures thereof. In many embodiments, the tetrapotassium pyrophosphate salt is selected, by virtue of its solubility being superior to that of the corresponding sodium salt in concentrated liquid detergent compositions. Although it is possible to employ a di-alkali metal di-hydrogen pyrophosphate as a proportion of the polyphosphate builder, its incorporation, eg 30–60% of the polyphosphate builder mix tends to produce a lower pH in the washing solution obtained simply by dissolution of the liquid detergent composition, providing a wash and stain removal detectably inferior to that obtained when the tetra alkali metal salt is employed instead, in otherwise identical compositions. The polyphosphate can be introduced into the detergent composition either as a solid which is dissolved, or in the form of an aqueous solution, but the percentages given herein are of a dry weight basis.

The organic complexing builders contemplated herein rend to fall into three classes, hydroxycarboxylic acid, aminocarboxylic acid and oxacarboxylic acid. Amongst hydroxycarboxylic acid and builders, a particularly suitable one is citric acid, usually introduced as the tri-alkali metal salt, and on cost grounds, as the trisodium salt. Mixtures of the hydroxycarboxylic acid builders and polyphosphates, for example citric acid and tetrapyrophosphate both in salt form, can also be used, often in a weight ratio of 2:1 to 1:2. Where a rather higher pH of the mix is desired, an alkaline adjuster, sodium metaborate is very suitable. It is desirable to use not more than about 20% of pyrophosphates and where tripolyphosphate is used not more than about 10 to 15%.

Within the class of aminocarboxylic acid builders, nitrilo, triacetic acid, normally alkali metal salt thereof, (NTA) is most prominent. Generally use of the salt tends to produce a somewhat higher pH than of a corresponding weight of hydroxycarboxylic acid complexing builder and probably as a result thereof the resultant built detergent composition tends to show slightly inferior hydrogen peroxide stability. At higher concentrations within the aforementioned range for builders it is preferable to downwardly adjust the pH of the mix by introducing it in part acid form. In practice, often not more than 10% NTA is employed. It can be employed to complement hydroxycarboxylic acid builders, the resulting mixture therewith generating an intermediate pH, for example a mixture of 12 to 6% sodium citrate and 3 to 9% NTA. Similar mixtures of NTA with polyphosphates such as tetrapyrophosphates can also be utilised.

Within the class of oxacarboxylic acids, carboxymethyloxysuccinate deserves mentioned. For practical reasons it is preferable to employ from 5 to 8% of this builder. Where higher than 8% builder is desired, the balance above 8% is more advantageously provided by one of the other aforementioned builders.

The sulphonate hydrotropes are suitably the alkali metal salts of benzene or methyl-substituted benzene sulphonates, most commonly xylene sulphonate and toluene sulphonate. Preferably the sodium or potassium salt is employed. A proportion of the hydrotrope can be provided by incorporation of one or more ethoxylated phosphate esters. Such esters chemically can be regarded as phosphate ester derivatives of the aforementioned non-ionic ethoxylate surfactants described hereinbefore. In many embodiments, the product used is a mixture of the two. The degree of ethoxylation in the ethoxylated moiety is generally the range from 2 to 12 and often in the range of 2 to 6, and the carbon chain length of the hydrophobic alkyl group R is normally from 9 to 18. Whilst it is possible to employ the closely related ethoxylated alkyl phenol phosphate esters, in which the alkyl group is often from $C_8$ to $C_{12}$, their use for such purposes is being increasingly viewed with hostility by water authorities because suitable methods have not yet been found to degrade them biologically. The phosphate esters often are available in the acid form and they can be employed as such in the liquid detergent compositions of the present invention, but their use in that way does tend to lower the pH of the composition and of the subsequent washing solution and if desired, the phosphate ester can be partially or completely neutralised with alkali metal hydroxide, especially sodium or potassium hydroxide, or ammonium hydroxide.

In general, the total proportion of sulphonate hydrotrope plus ethoxylated phosphate ester is normally selected within the range of from 3% to 12%, of which the sulphonate hydrotrope is frequently from 3 to 9% and the ethoxylated phosphate ester the balance. A small proportion of ethoxylated phosphate ester, for example from 1 to 3% can be advantageous in improving the washing ability of the composition for certain commonly encountered stains like cocoa, for example where the ratio of the anionic to non-ionic surfactant is relatively high, such as at approximately 1:1 or higher.

The stabiliser system for hydrogen peroxide in the composition comprises an amino methylene phosphonate or hydroxy alkyl diphosphonate and either or both of a low molecular weight aliphatic alcohol, and a polyhydroxy aliphatic carboxylate. The low molecular weight aliphatic alcohol is most preferably ethanol or isopropanol, particularly in the view of the combination of properties that each possess in that, not only do they effectively and surprisingly improve the storage stability of hydrogen peroxide in the composition, in combination with the other components despite the fact that their presence tends to increase the alkalinity of the solution, as measured by a standard pH electrode, but each also cooperates with the aforementioned hydrotropes in retaining a one phase system and consequently provides higher flexibility in formulating compositions. The low molecular weight aliphatic alcohol is employed, preferably, in an amount of at least 5% of the composition and generally not more than 15%. In many embodiments it is employed within the range of from 7 to 12%. The higher weight aliphatic alcohols such as propanol and butanol are considerably less desirable by virtue of their poorer water solubility so that the compounds can be employed to only a much smaller proportion of the composition than can ethanol/isoproponol. By way of example, many of the compositions described herein containing comparatively high amounts of surfactant and builder can remain in a single-storage stable phase when they contain 10% of ethanol, but when the same amount of butanol and propanol is employed instead, phase separation occurs.

The polyhydroxy aliphatic carboxylate generally contains at least 5 carbon atoms and normally up to 10 carbon atoms. Although the carbon chain in the molecule can be branched, in many effective examples the compound is linear, terminating at one end in a carboxylate group, and preferably having a chain length of 5, 6 or 7 carbon atoms. Desirably all, or at least the majority of the remaining carbon atoms are substituted by an hydroxyl group. The compound can be in acid form, but preferably is neutralised with an alkali metal, preferably sodium or potasium. Preferred compounds of this class include the acid or neutralised forms of gluconic acid and glycero-ido heptonate. Preferably, the polyhydroxy compound is employed in an amount of at least 0.08% of the composition and in many cases not more than 1%.

The phosphonate component of the stabilised system can be introduced in the acid form, but it will be recognised that, if the acid form is employed initially, to a certain extent the resultant solution will have a lower pH and impairment of overall washing performance can thereby ensue. The phosphonate component is therefore introduced preferably in an at least partial alkali metal salt form. By the term "amino methylene phosphonates" is meant any compound containing an amino group substituted by a methylene phosphonic acid group or salt thereof. Many suitable phosphonates can be represented by the general formula, in acid form:

$$[H_2O_3PCH_2[-[N(CH_2PO_3H_2)(CH_2)_p]-]_q-[N(MePO_3H_2)_2]$$

in which p is normally from 2 to 6 and q is normally from 0 to 2. Highly desirable examples are ethylene diamino tetra(methylene phosphonic acid)hexa potassium salt, and diethylene triamino penta(methylene phosphonic acid)hexa potassium salt. Further suitable examples include hexamethylene diamino tetra(methylene phosphonic acid), penta sodium salt and amino tri(methylene phosphonic acid)penta sodium salt. Where desired, one or more of the methylene groups linking the amino groups can be substituted at the carbon atom by a lower alkyl group or at one carbon only by an hydroxyl group or the substituents of two such suitably spaced, preferably adjacent carbon atoms can combine to form cycloaliphatic ring preferably containing 5 or 6 carbon atoms.

The aliphatic diphosphonates can conveniently be represented in acid form by the formula $YZC(PO_3H_2)_2$ in which Y represents an hydroxyl or amino group, the amino group itself optionally being substituted by a lower alkyl, a lower alkylamino or a lower hydroxyalkyl group, lower indicating from 1 to 4 carbon atoms, and Z represents a lower alkyl, preferably methyl group. Examples of such diphosphonates include 1-amino ethane-1,1-diphosphonic acid and 1-hydroxyethane-1,1-diphosphonic acid, and preferably the alkali metal salts thereof. Mixtures of any two or more of the aforementioned amino-methylene phosphonates and/or diphosphonates can be employed, as desired. Such a compound or compounds are preferably employed in an amount of at least 0.075% by weight of the composition and generally an amount of not more than 1% and often the amount is selected from the range of 0.1% to 0.4%. Use of larger amounts than 1% do not in general repay the additional cost of their incorporation, and for each phosphonate an amount is reached beyond which increasing the amount leads to impaired stabilisation.

When it is desired to include both the polyhydroxy carboxylate and the phosphonate in the composition, an extremely convenient and desirable way of so doing is to first obtain or produce a premix of these two components in the desired weight ratio e.g. 4:3 of the former to the latter and then use the premix.

In many of the detergent compositions of the present invention, the weight ratio of the polyhydroxy compound to the phosphonate is within the range of 3 to 1 to 1 to 3 and often within the range of 2 to 1 to 1 to 1, and their combined % is preferably from 0.2 to 1.0%. In other highly desirable embodiments of the present invention, the lower molecular weight aliphatic alcohol is selected within a weight ratio to the phosphonate of from 50:1 to 2.5:1, and preferably from 50 to 1 to 20 to 1, when the stabiliser system consists of the phosphonate and the alcohol, preferably employing a comparatively high amount of the phosphonate, namely at least 0.15% generally up to 0.4%. Most desirably the weight ratio is varied inversely to variation in the phosphonate concentrate. The product of the weight ratio of alcohol to phosphonate and the concentration of the phosphonate expressed as a percentage in the two component stabiliser system is preferably at least 8 and often from 9 to 12. It is specially desirable to employ all three stabiliser components together in the detergent composition especially in a combined amount of at least 0.2% for the polyhydroxy compound and the phosphonate, and at least 5% of the aliphatic alcohol. In many embodiments, it is convenient and advantageous to select the components within the ranges of 0.1 to 0.4% for each of the polyhydroxy and phosphonate components and from 5 to 12 and particularly from 8 to 12% for the aliphatic alcohol, especially ethanol.

The hydrogen peroxide can conveniently be incorporated in the form of the appropriate amount of concentrated hydrogen peroxide, eg 35 to 85% w/w hydrogen peroxide commercially available, which often contains from 10 ppm pyrophosphate. In one other convenient manner of incorporating the hydrogen peroxide and stabiliser system, the appropriate amount of a premix is employed, the premix consisting essentially of (a) from 20 to 35% by weight, based on the composition, of hydrogen peroxide, (b) water in an amount of at least 3 parts per 7 parts by weight of hydrogen peroxide and (c) an organics component comprising a mixture of stabiliser in a weight ratio to the hydrogen peroxide of from 1:4 to 3:1 and comprising a low molecular weight monohydric aliphatic alcohol and an aminomethylenephosphonate and/or an hydroxyalkyldiphosphonate optionally together with up to thrice its weight of a polyhydroxycarboxylate to a total weight ratio to the monohydric alcohol of from 1:4.5 to 1:60.

The premix is described in greater detail in our copending application entitled "Dilutable Hydrogen Peroxide Compositions" filed concurrently herewith, which description is incorporated herein by reference. Of course, detergent compositions made from the premix can be further augmented with additional monohydric alcohol if desired, for example to assist in the incorporation of a poorly soluble ingredient.

Hydrogen peroxide is often incorporated in the solution in the range of from 3 to 10%, frequently from 5 to 8% and for industrial uses often from 10 to 20% (expressed as 100%.) Lower concentration of hydrogen peroxide could be employed, but in general these would not enable a desirable amount of active oxygen to be provided in the washing solution unless the concentration of the other components in the detergent composition were correspondingly reduced also. It will be recognised that the concentration of hydrogen peroxide in the range 5 to 8% in the detergent composition when diluted to form a washing solution by a factor selected within the range of 100:1 to 1000:1 and often preferably from 200:1 to 500:1 can readily provide active oxygen concentrations commensurate with those provided by normal concentrations of many heavy duty solid detergent compositions or by the addition of an active oxygen bleach at recommended levels to commercially obtainable active oxygen-free liquid detergents.

In practice, the total proportion of components other than water and hydrogen peroxide normally is selected to be not greater than 52%. Use of a higher proportion, particularly where the composition contains relatively high proportions of builder and anionic surfactants tends to become more sensitive to phase separation. Although a total proportion, eg below 20% of such components could be employed in compositions, whether built or not, it is more desirable to provide such components to a total proportion of at least 20% and more preferably at least 30% of the liquid composition, not only from the point of view of reducing the volume of unnecessary water to be transported but also because the user often associates dilute products with inferior products. In many embodiments, the totaled proportions of components other than water and hydrogen peroxide in the built compositions is at least 35% and frequently not more that 45%.

The prefered concentration of polyphosphate or citrate in the detergent compositions is from 9 to 16%. The proportion of anionic sulphate or sulphonate surfactant plus ethoxylated non-ionic surfactant in the concentrate is preferably within the range of from 6 to 15%, the weight ratio of anionic to non-ionic surfactants normally being selected within the range of 5:2 to 2:5, in order to produce a balanced surfactant mix for the treatment of the general mix of household stains. Where the composition is intended for a more specific stain, one that is known to be sensitive to a particular type of surfactant, then anionic to non-ionic surfactant weight ratios outside the aforementioned range can be readily contemplated. Hence, e.g. where the product is intended primarily for greasy stains, a lower anionic to non-ionic ratio can be more desirable, for example in the range of 1 to 2.5 to 1 to 5. Additionally, in determining the actual amounts of various components to be incorporated in the mixture, it is desirable to maintain the builder e.g. polyphosphate or citrate to anionic surfactant ratio within the range of 1:1 to 5:1 and particularly from 2:1 to 4:1 so as to take advantage of the synergistic interaction between those two components. The anionic surfactants are present preferably in an amount from 3 to 8%, and often at least 4%, and the builder is preferably polyphosphate or citrate, frequently at from 9 to 16%, and the non-ionic surfactant content is normally at least 3% and again often at least 4%, with the result that the anionic sulphonate or sulphate surfactant and non-ionic ethoxylated surfactant are present in such compositions in total amount advantageously of at least 8%.

Additionally, it is desirable for the customary reasons to incorporate in the detergent composition a small proportion of detergent adjuvants, the total amount of adjuvants, generally up to 8% and in many cases, being from 1 to 5%. Examples of adjuvants include soil anti-redeposition agents, for example polyvinylpyrrolidone, and sodium carboxymethylcellulose, often in an amount of from 0.1 to 0.3% and an optical brightener or a range of brighteners to allow for the various sorts of fibres from which household laundry articles are made, to a total amount often in the range of 0.5 to 2% of the composition. It is generally desirable to select as brightener those of the stilbene type which have demonstratable storage compatibility with hydrogen peroxide in solution. In general, the composition will also contain a very small proportion of alkali metal sulphate formed during the neutralisation of the anionic surfactant during its preparation. The compositions can also include a small amount of mono- or di or tri ethanolamine, or alkali metal borates as pH adjusters, but alkali metal silicates and carbonates are excluded, or of amphoteric surfactants such as imidazoline based fatty acid carboxysulphates, from 0.5 to 2%. The adjuvants can also include a small amount of foam regulators, for example ethylene oxide/propylene oxide copolymers such as are available from Ugine Kuhlmann, France under the Tradename PLURONIC, grades L42 and F.108, and soaps i.e. alkali metal salts of aliphatic carboxylic acids, having a chain length of at least 8 carbon atoms and normally from 10 to 20 carbon atoms, examples of which include stearate, and soaps derived from natural sources, particularly tallow and coconut oils, again often up to 2% by weight. Other adjuvants can comprise compatible tarnish inhibitors, cationic softeners, dyes, perfumes and thickeners, such as xanthan gum for citrate-built formulations. The amounts of the adjuvants can be varied by the skilled worker within or outside the exemplified ranges.

Some especially preferred built compositions according to the present invention comprise from 8 to 12% in total of anionic sulphate or sulphonate surfactant and nonionic ethoxylated surfactants of which preferably from 3 to 8% is anionic sulphate or sulphonate surfactant and preferably from 3 to 8% is non-ionic ethoxylated surfactant, from 9 to 15% alkali metal preferably, potassium tetra pyrophosphate; from 3 to 6% alkali metal aryl sulphonate hydrotrope; from 5 to 12%, preferably 8 to 12% ethanol; from 5 to 10%, preferably 5 to 8% hydrogen peroxide; from 0.2 to 1% in total of a polyhydroxy linear $C_6$ or $C_7$ aliphatic carboxylate, preferably an alkali metal gluconate and an alkali metal methylene phosphonate complexing agent, preferably ethylene diaminetetra methylene phosphonate or hexamethylene diamine tetra methylene phoshonate or diethylene triamine penta methylene phosphonate, preferably in a weight ratio of from 2:1 to 1:1, up to 3% of detergent adjuvants such as described herein, including a soil antiredeposition agent and an optical brightener; and the balance, water, preferably from 55 to 65%. Other compositions include corresponding compositions containing at least 5% builder and in which all or part of the 9–16% polyphosphates or citrate builder is replaced by 4 to 7% carboxymethyloxy succinate or 3 to 9% NTA.

In a modification of the invention, no builder is employed, and instead the compositions contain additional surfactant, mainly nonionic surfactant. Consequently, unbuilt detergent compositions according to the present invention contain at least 5% nonionic surfactant and in total at least 10% surfactants. The presence of the extra surfactants means that the balance of anionic to non-ionic generally favours the nonionic to a much greater extent than in built compositions according to the present invention. Thus, in unbuilt compositions, the anionic surfactant is normally selected in the range of 3 to 15%, but the nonionic is normally selected in the range of 5 to 35%. The weight ratio of anionic surfactant to nonionic surfactant is preferably selected in the range of 1:1 to 1:6, and in practice is often likely to be in the range of 1:3 to 1:6. The anionic surfactant often represents from 3 to 10% of the unbuilt composition and the nonionic surfactant at least 15% and frequently from 20 to 35%. In a specially preferred unbuilt compositions, the surfactants concentration is not more than 40% and particularly is from 25 to 40%, of which the anionic comprises from 3 to 8% and the nonionic from 22 to 35%. The unbuilt compositions can, in practice, be slightly more concentrated than the built compositions. Thus, the total proportion of components other than water and hydrogen peroxide is generally up to 65% and frequently from 40 to 60%.

In the other respects, for example selection of and concentrations of hydrotrope, stabiliser, hydrogen peroxide and adjuvants the aforementioned description for the built compositions applies likewise to the unbuilt compositions according to the present invention.

It is especially desirable that the compositions, either built or unbuilt, be free from alkali metal carbonates or silicates.

The compositions described herein can be made conveniently by mixing the components in the desired proportions in a mixing tank, and to avoid and minimise loss of hydrogen peroxide by decomposition it is preferable to add it as the last step, or at least after the two stabiliser components have been introduced. The surfactants are preferably mixed at a moderately elevated temperature, often from 35° to 60° C., and then combined with the other components which brings the mixture to near ambient for the introduction of the hydrogen peroxide. Preferably the polyphosphate is introduced in aqueous solution, either supplied as such by the manufacturer or prepared on site by dissolution. The minor components, detergent adjuvants and sulphonate hydrotrope can be mixed in with the surfactant mix. The various solutions and water can be introduced consecutively or concurrently into the mixing tank except as mentioned hereinbefore that the hydrogen peroxide solution is preferably introduced last or starting last. Although the process has been described in a batch manner it will be readily apparent to a skilled engineer how to carry out the process on a continuous basis. The composition, when thoroughly mixed, can then be poured into containers or dispensers. By virtue of the superior storage stability of at least some of the embodiments, of the invention, such as those losing less than 1% Avox a week the containers or dispensers for such embodiments need not be of the specially vented and thus expensive types, but instead containers having a slightly loose fitting closure means, such as cap or stopper can be used.

According to a further aspect of the present invention, washing processes, or laundering, according to the present invention can be carried out by diluting the liquid concentrate of the present invention with water to a desired extent, and contacting the aqueous washing solution with the articles to be washed at any temperature from ambient to the boiling point of the solution. In many processes, the process is carried out at hand hot temperature or hotter, often a temperature of at least 45° C. and, depending on local washing customs, frequently at a temperature of at least 60° C.

It is a feature of the present invention that there is provided a one shot liquid detergent composition containing not only hydrogen peroxide, but also a high concentration of anionic and non-ionic surfactants of the order needed to form a washing solution without the addition of any further components. However, if it is desired, the detergent composition described herein before can be employed in conjunction with one or more bleach activators, i.e. compounds which react in aqueous solution with hydrogen peroxide to generate peroxy acids, preferably added separately to the washing solution to prevent premature interaction. Such compounds are normally N-acyl or O-acyl compounds. Typical examples of the classes of each activator which each represents, includes N,N,N',N',-tetraacetylethylene-diamine of N-acylated alkyleneamines, benzoic or phthalic anhydride, tetra acetyl glycoluril,N-alkyl-N-sulphonyl-carbonamides, N-acyl hydantoins, carbonic acid esters, triacetyl cyanurate, O,N,N'-tri substituted hydroxylamines and diacyl peroxides such as benzoyl glutaryl peroxide and diphthaloyl peroxide. In comparison with the use of such activators in conjunction with solid detergent compositions, inter-reaction between the active oxygen containing compound and the activator can occur more quickly by virtue of the fact that the hydrogen peroxide is already in solution whereas for solid peroxygen compounds, and especially the commonly used sodium perborate tetrahydrate at hand-hot temperatures or cooler, its rate of dissolution can be a restraining factor. If an activator is employed in conjunction with the detergent composition, then the preferred washing temperatures tend to be somewhat lower, preferably falling in the range from ambient to 60° C. Naturally, a convenient mole ratio of activator to hydrogen peroxide is from 2 to 1 to 1 to 2, and especially 1 to 1 in the washing solution.

Generally, the concentrates of the present invention are diluted to produce washing solutions containing from 0.1 to 1.5 gpl surfactant. In many cases, the concentration of surfactants is within the range of 0.2 to 0.6 gpl and such concentrations can be obtained from many of the preferred detergent compositions of the present invention such as those containing at least 8% surfactants at a dilution of greater than 100 to 1, and often at a dilution of from 200 to 1 to 300 to 1.

The washing period can range from as low as a minute or a few minutes e.g. 5 minutes at washing temperature at or near the boiling point of the washing solution, e.g. from 90° to 100° C. up to a period of several hours at cooler wash temperatures, such as overnight steeping at ambient temperature. The washing period can be varied at the discretion of the user. Typical washing times at a temperature of 40° to 70° C. are of the order from 5 to 40 minutes.

In addition to laundry use, the compositions can be used neat or after dilution to cleanse hard surfaces, such as those of enamel, paint, metal, plastic, wood, glass or ceramics.

Having described the invention in general terms, specific embodiments will be described hereinafter more fully by way of example only. It will be recognised that by employing his general knowledge and the information contained herein before, the expert in the field of liquid detergents will be able to vary the proportions and components in the composition.

EXAMPLES 1-40 AND 43-64

Liquid detergent compositions according to the present invention were prepared by the following general route, employing the weight proportions summarised in Tables 1 2 and 3 below.

First, a mixture of the anionic and nonionic surfactants in the correct proportions was heated to approximately 40° to 45° C. with constant stirring until a clear solution occured. The sulphonate hydrotrope and ethoxylated phosphate ester when employed were then introduced in the desired proportions with stirring followed by the builder, often together with a proportion of the total deionised water content of the mixture which cooled the mixture. Next the ethanol the residual amount of water the polyhydroxy carboxylate and the phosphonate components were added as well as the detergent adjuvants, where employed. Finally, the hydrogen peroxide solution was introduced. The mixture was vigorously stirred.

The components used in the compositions were as follows:

| | |
|---|---|
| anionic surfactants | |
| $A_1$ | sodium dodecyl benzene sulphonate (HETSULF 60S) |
| $A_2$ | sodium linear alkyl benzene sulphonate (NANSA SS60) |
| $A_3$ | sodium primary alcohol sulphate (PERLANKROL DSA) |
| amphoteric surfactant | |
| $A_4$ | imidazoline based - coconut carboxysulphate hydrophile (MIRANOL 3MCT) |
| nonionic surfactants | |
| $N_1$ | $C_{15}$ sec alcohol ethoxylate (n = 9) TERGITOL 15S9 |
| $N_2$ | middle cut primary $C_{12}$–$C_{15}$ alcohol ethoxylate (n = 9) ETHYLAN D259 |
| $N_3$ | synthetic primary alcohol ethoxylate (n = 7) SYNPERONIC A7 |
| $N_4$ | lower cut primary alcohol ethoxylate (n = 9) ETHYLAN CD919 |
| Hydrotropes | |
| $HX_1$ | sodium xylene sulphonate (SX96) |
| $HX_2$ | sodium xylene sulphonate (ELTESOL SX30) |
| Phosphate esters | |
| $HE_1$ | ethoxylated phosphate ester (TRITON QS30) |
| $HE_2$ | ethoxylated phosphate ester (n = 2) (BRIPHOS L2D) |
| polyhydroxycarboxylate | |
| SG | sodium gluconate |
| phosphonate stabiliser | |
| $SP_1$ | hexapotassium ethylene diamine tetra (methylene phosphonate) |
| $SP_2$ | aminotris (methylene phosphonic acid) |
| $SP_3$ | diethylenetriaminepenta(methylene phosphonic acid |
| $SP_4$ | hexamethylenediaminetetra(methylene phosphonate) hexapotassium salt |
| SE | Ethanol-industrial grade methylated spirits |
| HP | Hydrogen peroxide - 35% W/W aqueous solution containing 50 ppm pyrophosphate |
| Builder | |
| $B_1$ | Potassium tetra pyrophosphate (solid) |
| $B_2$ | Potassium tetra pyrophosphate (aqueous solution) (KALIPOL 4KP) |
| $B_3$ | Potassium polyphospate (chain length 4) (KALIPOL 18) |
| $B_4$ | Sodium Citrate |
| $B_5$ | Nitrilotriacetic acid, sodium salt |
| $B_6$ | Trisodium carboxymethyloxysuccinate. |
| Water | Deionised except where marked * in which Widnes, Cheshire municipal water was used untreated. |

Similar compositions to one or more of the exemplified compositions were obtained by substituting alternative nonionic surfactants such as poly oxyethylene alkyl ethers or poly oxyethylene alkyl ethers for the specified ethoxylates, and/or substituting ammonium primary alcohol ether sulphate for the specified sulphate surfactant, and/or by substituting ethoxylated phosphate mono ester of higher degree of ethoxylation for the specified di-ester, and or by substituting other polyphosphate builders for those specified.

The storage stability trial for Tables 1 and 2 was effected by transferring a small sample of the given composition into a clean plastic bottle housed in a constant temperature enclosure at 32° C. The available oxygen concentration (Avox) in the composition was determined by the standard acidified potassium permanganate titration method on a small portion extracted from the sample and the result obtained after storage for a given period compared with the original content. The result given in Tables 1 and 2, is the percentage of Avox lost from the hydrogen peroxide after 3 weeks storage, except in Examples 43 to 52 in which it is after 4 weeks storage. The storage stability trials for Table 3 were carried out in the same manner as that for Tables 1 and 2 except that the temperature of the enclosure was 50° C. in order to accelerate proceedings. The result is given after 24 hours, approximately. The gluconate and phosphonate were introduced separately, except in Examples 1 to 30 and 43 to 58 were they were provided in the form of a premix of SG and $SP_1$ available under the tradename POLYRON 1020.

TABLE 1

| Ex | Weight % of component in composition | | | | | | | | | |
|---|---|---|---|---|---|---|---|---|---|---|
| | Surfactant | | | | | | | | | |
| | Nonionic | | Anionic | | Hydrotrope | | | Builder | | |
| No | $N_1$ | $N_4$ | $A_1$ | $A_2$ | $HX_1$ | $HX_2$ | $HE_1$ | $B_1$ | $B_2$ | $B_4$ |
| 1 | 6 | | 4 | | 5 | | | 15 | | |
| 2 | 6 | | 4 | | 5 | | | 15 | | |
| 3 | 5 | | 5 | | 5 | | | 15 | | |
| 4 | 5 | | 5 | | 5 | | | 15 | | |
| 5 | 4 | | 6 | | 5 | | | 15 | | |
| 6 | 4 | | 6 | | 5 | | | 15 | | |
| 7 | 3 | | 7 | | 5 | | | 15 | | |
| 8 | 3 | | 7 | | 5 | | | 15 | | |
| 9 | 3 | | 7 | | 5 | | 10 | 15 | | |
| 10 | 3 | | 7 | | 5 | | 10 | 15 | | |
| 11 | 7 | | | | 5 | | 3 | 15 | | |
| 12 | 7 | | | | 5 | | 3 | 15 | | |
| 13 | 5 | | | 5 | | 5 | | | 15 | |
| 14 | 5 | | | 5 | | 5 | | | 15 | |
| 15 | 5 | | | 5 | | 5 | | | 15 | |
| 16 | 5 | | | 5 | | 5 | | | 15 | |
| 17 | 5 | | | 5 | | 5 | | | 15 | |
| 43 | 4 | | 6 | | 6 | | 15 | 15 | | |
| 44 | 4 | | | 6 | | 6 | | 15 | | |
| 45 | | 4 | | 6 | | 6 | | | | 10 |
| 46 | | 4 | | 6 | | 6 | | | | 10 |
| 47 | | 4 | | 6 | | 6 | | | | 15 |
| 48 | | 4 | | 6 | | 6 | | | | 15 |
| 49 | 4 | | | 6 | | 6 | | 15 | | |
| 50 | 4 | | | 6 | | 6 | | 15 | | |

| Ex | Weight % of component | | | | | | | |
|---|---|---|---|---|---|---|---|---|
| | Stabiliser | | | | | | | Avox |
| No | SE | SG | $SP_1$ | $SP_2$ | HP | Water | pH | loss |
| 1 | | 0.20 | 0.15 | | 7 | Balance | 9.3 | 4 |
| 2 | 10 | " | " | | 7 | | 9.5 | 2 |
| 3 | | " | " | | 7 | | 9.3 | 7 |
| 4 | 10 | " | " | | 7 | | 9.4 | 4 |
| 5 | | " | " | | 7 | | 9.2 | 2 |
| 6 | 10 | " | " | | 7 | | 9.2 | 2 |
| 7 | | " | " | | 7 | | 9.2 | 4 |
| 8 | 10 | " | " | | 7 | | 9.3 | 3 |
| 9 | | " | " | | 7 | | 8.2 | 4 |
| 10 | 10 | " | " | | 7 | | 8.3 | 2 |
| 11 | | " | " | | 7 | | 7.8 | 2 |
| 12 | 10 | " | " | | 7 | | 8.0 | 1 |
| 13 | 10 | 0.05 | 0.04 | | 7 | | 9.4 | 12 |
| 14 | 10 | 0.10 | 0.08 | | 7 | | 9.2 | 10 |
| 15 | 10 | 0.20 | 0.15 | | 7 | | 9.0 | 3 |
| 16 | 10 | 0.30 | 0.23 | | 7 | | 9.0 | 3 |
| 17 | 10 | 0.40 | 0.30 | | 7 | | 9.0 | 5 |
| 43 | 10 | 0.20 | 0.15 | | 7 | | 9.4 | 2 |
| 44 | 10 | 0.20 | 0.15 | | 7 | | 9.1 | 3 |
| 45 | | 0.20 | 0.15 | | 7 | | 7.4 | 3 |
| 46 | 10 | 0.20 | 0.15 | | 7 | | 7.4 | 2 |
| 47 | | 0.20 | 0.15 | | 7 | | 7.6 | 3 |
| 48 | 10 | 0.20 | 0.15 | | 7 | | 7.7 | 2 |
| 49 | | 0.20 | 0.15 | | 7 | * | 9.4 | 4 |
| 50 | 10 | 0.20 | 0.15 | | 7 | * | 9.2 | 3 |

TABLE 2

| Ex | Weight % of component in composition | | | | |
|---|---|---|---|---|---|
| | Surfactants | | | | |
| | Nonionic | Anionic | Amph | Hydrotrope | Builder |

TABLE 2-continued

| No | $N_2$ | $N_3$ | $A_2$ | $A_3$ | $A_4$ | $HX_2$ | $HE_2$ | $B_1$ | $B_2$ | $B_3$ |
|---|---|---|---|---|---|---|---|---|---|---|
| 18 | 3 | | 7 | | | 5 | | | 15 | |
| 19 | 3 | | 7 | | | 5 | 1 | | 15 | |
| 20 | 3 | | 7 | | | 5 | 2 | | 15 | |
| 21 | 3 | | 7 | | | 5 | 3 | | 15 | |
| 22 | 3 | | 7 | | | 5 | | | 15 | |
| 23 | 7 | | 3 | | | 5 | | | 15 | |
| 24 | 4 | | 6 | | | 5 | | | 15 | |
| 25 | 6 | | 4 | | | 5 | | | 15 | |
| 26 | 5 | | 5 | | | 5 | | | 15 | |
| 27 | 3 | | | | | 5 | 7 | | 15 | |
| 28 | 4 | | | | | 5 | 6 | | 15 | |
| 29 | 7 | | 7 | | | 5 | | | 10 | |
| 30 | 6 | | 4 | | | 5 | | | 10 | |
| 31 | | 10 | | 3.3 | | 2 | | | 6.5 | |
| 32 | | 10 | 3.3 | | | 2 | | | 6.5 | |
| 33 | | 10 | | 3.3 | | 3 | | | | 6.5 |
| 34 | | 10 | 3.3 | | | 3 | | | | 13.5 |
| 35 | | 10 | | | 3.3 | 3 | | | | 13.5 |
| 36 | 5 | | | | | 7 | 5 | | 15 | |
| 37 | 7 | | | | | 7 | 3 | | 15 | |
| 38 | 5 | | | | | 5 | 5 | | 10 | |
| 39 | 5 | | 5 | | | 5 | | 10 | | |
| 40 | 5 | | 5 | | | 5 | | 10 | | |
| 51 | 5 | | 4 | | | 5 | | 15 | | |
| 52 | 6 | | 6 | | | 5 | | 15 | | |

| Ex | Weight % of component | | | | | | | |
|---|---|---|---|---|---|---|---|---|
| | Stabiliser | | | | | | | Avox |
| No | SE | SG | $SP_1$ | $SP_2$ | HP | Water | pH | loss |
| 18 | | 0.20 | 0.15 | | 7 | balance | 8.9 | 18 |
| 19 | | " | " | | 7 | | 8.2 | 14 |
| 20 | | " | " | | 7 | | 8.1 | 8 |
| 21 | | " | " | | 7 | | 8.7 | 10 |
| 22 | 10 | " | " | | 7 | | 9.1 | 4 |
| 23 | 10 | " | " | | 7 | | 9.2 | 3 |
| 24 | 10 | " | " | | 7 | | 9.2 | 2 |
| 25 | 10 | " | " | | 7 | | 9.2 | 4 |
| 26 | 10 | " | " | | 7 | | 9.1 | 2 |
| 27 | | " | " | | 7 | | 7.8 | 4 |
| 28 | | " | " | | 7 | | 8.0 | 6 |
| 29 | | " | " | | 7 | | 8.1 | 4 |
| 30 | | " | " | | 7 | | 8.5 | 4 |
| 31 | 6.5 | | | to pH | 3.3 | | 7 | 2 |
| 32 | 6.5 | | | to pH | 3.3 | | 7 | 1 |
| 33 | 6.5 | | | to pH | 3.3 | | 7 | 6 |
| 34 | 6.5 | | | to pH | 3.3 | | 7 | 3 |
| 35 | 6.5 | | | to pH | 3.3 | | 7 | 3 |
| 36 | | 0.2 | 0.15 | | 7 | | 7.9 | 1 |
| 37 | | 0.2 | " | | 7 | | 8.5 | 2 |
| 38 | | 0.2 | " | | 7 | | 7.7 | 2 |
| 39 | | 0.2 | " | | 5 | | 8.7 | 7 |
| 40 | | 0.4 | 0.3 | | 5 | | 8.6 | 8 |
| 51 | | 0.2 | 0.15 | | 7 | | 9.4 | 2 |
| 52 | 10 | 0.2 | 0.15 | | 7 | | 9.5 | 3 |

TABLE 3

| Ex | Weight % of component in composition | | | | | | | |
|---|---|---|---|---|---|---|---|---|
| | Surfactant | | | | Builder | | | |
| No | Nonionic $N_4$ | Anionic $A_2$ | Hydrotrope $HX_2$ | $B_1$ | $B_4$ | $B_5$ | $B_6$ | HP |
| 53 | 4 | 6 | 6 | 15 | | | | 7 |
| 54 | 4 | 6 | 6 | | 15 | | | 7 |
| 55 | 4 | 6 | 6 | | | 15 | | 7 |
| 56 | 4 | 6 | 6 | | | | 5 | 7 |
| 57 | 4 | 6 | 6 | 15 | | | | 7 |
| 58 | 4 | 6 | 6 | 15 | | | | 7 |
| 59 | 4 | 6 | 6 | 15 | | | | 7 |
| 60 | 4 | 6 | 6 | 15 | | | | 7 |
| 61 | 4 | 6 | 6 | 15 | | | | 7 |
| 62 | 4 | 6 | 6 | 15 | | | | 7 |
| 63 | 4 | 6 | 6 | 15 | | | | 7 |
| 64 | 4 | 6 | 6 | 15 | | | | 7 |

| Ex | Weight of components in composition | | | | | | | Avox |
|---|---|---|---|---|---|---|---|---|
| | Stabiliser | | | | | | | loss |
| No | SE | SG | $SP_1$ | $SP_3$ | $SP_4$ | Water | pH | % |
| 53 | 10 | 0.2 | 0.15 | | | Balance | 9.3 | 7 |
| 54 | 10 | 0.2 | 0.15 | | | | 9 | 7 |
| 55 | 10 | 0.2 | 0.15 | | | | 8 | 13 |
| 56 | 10 | 0.2 | 0.15 | | | | 8.3 | 10 |
| 57 | 10 | 0.2 | 0.15 | | | | | 4 |
| 58 | 10 | 0.2 | 0.15 | | | | | 3 |
| 59 | | 0.2 | 0.15 | | | | | 6 |
| 60 | 10 | 0.2 | 0.15 | | | | | 5 |
| 61 | | 0.2 | | 0.15 | | | | 5 |
| 62 | 10 | 0.2 | | 0.15 | | | | 4 |
| 63 | 10 | 0.2 | | | 0.15 | | | 6 |
| 64 | 10 | 0.2 | | | 0.15 | | | 5 |

Under the storage conditions, it was observed that almost all the compositions exemplified remained throughout storage in a single phase despite the presence of both hydrogen peroxide and polyphosphate builder in high concentrations, and that phase stable compositions similar to those (18,37) which separated after several months, were obtainable by a modest redution in the polyphosphate concentration or addition of ethanol in amounts sufficient to enhance the stability of the hydrogen peroxide in the composition or slightly more hydrotrope.

From Tables 1, 2 and 3 it can be seen that incorporation of ethanol within the limits specified herein in conjunction with phosphonate or phosphonate/gluconate improves the storage stability of the alkaline composition, and that as the level of glyconate/phosphonate stabiliser mix is increased, the storage stability of the composition increases up to certain level and thereafter declines.

The washing capability of various of the above mentioned compositions have been tested and the results are summarised in Tables 4, 5 and 6.

The washing trials were carried out in the following manner:

Prestained swatches of cotton were washed in a laboratory scale washing machine, sold under the name TERGOTOMETER (US Testing Corporation) which simulates the action of a vertical agitator type of domestic washing machine. The machine trials were carried out under standard conditions of two stained swatches, each of 5 g, being washed at a temperature maintained at 60° C. with one liter of an aqueous washing solution containing 4 grams of the selected detergent composition. For the compositions according to the present invention this resulted generally in an initial surfactant concentration in the range of about 0.3 to 0.5 gpl, and an initial builder concentration in the range of from 0.2 gpl to 0.8 gpl. The first washed swatches were removed from the wash water after 10 minutes washing, rinsed with cold water and dried, and the second removed after 20 or 30 minutes washing and similarly rinsed and dried. The extent of stain removal from each swatch was determined by measuring the reflectance of the swatches before and after washing, using a Zeiss ELREPHO Reflectance Photometer having a Xenon lamp light source equipped with a y-tristimulus filter. Each swatch was measured four times with a backing of three thicknesses of material. The reflectance readings were averaged and the % stain removal (abbreviated to %SR) was obtained using the following formula:

$$\% \text{ stain removal} = 100 \times (R_f - R_i)/(R_u - R_i)$$

where $R_u$ represents reflectance of the unstained cloth, $R_i$ reflectance of the cloth after staining, and $R_f$ reflectance of the the stained cloth after bleaching. Swatches of cotton stained with red wine were obtained from E.M.P.A., St. Gallen, Switzerland. Swatches of other stained fabrics were obtained by padding the appropriate fabric through an appropriate stain solution, partially drying the fabric with an infra red drier, and repeating the padding and drying cycle twice more.

In the washing trials summarised in Table 4 and 5, the washing solution water had a hardness of 150 ppm as calcium carbonate in a Ca:Mg ratio of 2:1 and in those summarised in Table 6, a hardness of 250 ppm as calcium carbonate in a Ca:Mg ratio of 3:1.

In Tables 5, and 6 the detergent composition of the present invention additionally contained 0.5% by weight of a bleach stable stilbene optical brightener obtainable under the name UVITEX BHT. Washing trials using compositions C41, and C42 are present by way of comparison only. The composition C41 was a commercially available built liquid detergent composition WISK, and C42 was an approximately 50/50 W/W mixture of WISK with an active-oxygen containing bleach additive CLOROX 2. Analysis of the products C41 and C42 showed that at the levels of detergent composition employed, the washing solution contained total surfactants in the range of 0.3 to 0.4 gpl and an initial builder plus pH adjuster concentration of about 0.4 gpl. These concentrations are very comparable with the concentrations of surfactants and builders present under standard conditions of use of the invention compositions (4 gpl) and in broad terms double those when the invention compositions are used at only 2 gpl.

TABLE 4

| Example/ comparison composition used | Washing conditions | Stain | % Stain removal after 10 min | 20 min |
|---|---|---|---|---|
| 48 | Standard | Red Wine | 61 | 67 |
| 48 | " | Cocoa | 28 | 30 |
| 48 | " | Tea | 52 | 58 |
| 48 | " | EMPA 101 | 42 | 47 |
| C42 | 4 g/l | Red Wine | 56 | 63 |
| C42 | " | Cocoa | 14 | 19 |
| C42 | " | Tea | 51 | 60 |
| C42 | " | EMPA 101 | 27 | 32 |
| 48 | 2 g/l | Red Wine | 56 | 63 |
| 48 | " | Cocoa | 25 | 27 |
| 48 | " | Tea | 47 | 54 |
| 48 | " | EMPA 101 | 33 | 39 |
| C41 | " | Red Wine | 52 | 60 |
| C41 | " | Cocoa | 16 | 20 |
| C41 | " | Tea | 40 | 43 |
| C41 | " | EMPA 101 | 34 | 41 |

TABLE 5

| Example/ comparison composition used | Washing conditions | Stain | % Stain removal after 10 min | 20 min |
|---|---|---|---|---|
| 4 | Standard | Red Wine | 63.4 | 65.4 |
| 4 | " | Cocoa | 28.7 | 33.3 |
| 4 | " | Tea | 53.5 | 55.8 |
| 4 | " | EMPA Standard | 51.7 | 57.4 |
| 2 | " | Red Wine | 59.6 | 64.5 |
| 2 | " | Cocoa | 38.5 | 43.8 |
| 2 | " | Tea | 42.9 | 56.5 |
| 2 | " | EMPA Standard | 52.4 | 59.6 |
| 6 | " | Red Wine | 59.7 | 66.2 |
| 6 | " | Cocoa | 33.0 | 37.3 |
| 6 | " | Tea | 49.7 | 59.8 |
| 6 | " | EMPA Standard | 52.5 | 59.1 |
| 12 | " | Red Wine | 57.6 | 61.8 |
| 12 | " | Cocoa | 25.6 | 36.6 |

TABLE 5-continued

| Example/ comparison composition used | Washing conditions | Stain | % Stain removal after 10 min | 20 min |
|---|---|---|---|---|
| 12 | " | Tea | 49.1 | 55.5 |
| 12 | " | EMPA Standard | 50.0 | 54.8 |
| 2 | 2 g/l | Red Wine | 50.8 | 54.6 |
| 2 | " | Cocoa | 6.6 | 8.6 |
| 2 | " | Tea | 28.5 | 33.8 |
| 4 | " | Red Wine | 53.1 | 56.5 |
| 4 | " | Cocoa | 6.0 | 9.5 |
| 4 | " | Tea | 26.5 | 29.9 |
| 6 | " | Red Wine | 50.1 | 52.6 |
| 6 | " | Cocoa | 6.5 | 9.1 |
| 6 | " | Tea | 26.3 | 29.4 |
| C41 | " | Red Wine | 38.5 | 40.6 |
| C41 | " | Cocoa | 2.2 | 3.6 |
| C41 | " | Tea | 4.4 | 10.9 |
| C42 | 4 g/l mix | Red Wine | 44.9 | 53.4 |
| C42 | " | Cocoa | −1.5 | 7.8 |
| C42 | " | Tea | 6.2 | 31.6 |

TABLE 6

| Example/ comparison composition used | Washing conditions | Stain | % Stain removal after 10 min | 20 min |
|---|---|---|---|---|
| 18 | Standard | Red Wine | 71.8 | 79.7 |
| 18 | " | Cocoa | 23.7 | 39.1 |
| 18 | " | Tea | 46.9 | 62.0 |
| 19 | " | Red Wine | 72.7 | 79.8 |
| 19 | " | Cocoa | 16.4 | 33.0 |
| 19 | " | Tea | 46.6 | 61.2 |
| 21 | " | Red Wine | 71.9 | 80.4 |
| 21 | " | Cocoa | 29.0 | 37.8 |
| 21 | " | Tea | 47.3 | 63.2 |
| 26 | " | Red Wine | 74.9 | 81.9 |
| 26 | " | Cocoa | 22.2 | 37.4 |
| 26 | " | Tea | 50.4 | 66.4 |
| 29 | " | Cocoa | 14.0 | 24.0 |
| 30 | " | Cocoa | 15.0 | 14.0 |
| C41 | 2 g/l | Red Wine | 60.4 | 66.2 |
| C41 | " | Cocoa | 17.6 | 29.1 |
| C41 | " | Tea | 23.9 | 27.6 |
| C41 | 4 g/l | Red Wine | 65.2 | 67.0 |
| C41 | " | Cocoa | 18.2 | 33.9 |
| C41 | " | Tea | 18.2 | 33.9 |
| C42 | 4 g/l mix | Red Wine | 66.3 | 76.6 |
| C42 | " | Cocoa | 12.2 | 26.9 |
| C42 | " | Tea | 25.2 | 62.3 |

From Tables 4, 5 and 6 it can be readily seen that the invention compositions were very effective and, in several, better stain removers on the range of stains tested than were comparison compositions C41, C42 and C43. It will be recognised therefore, that the compositions of the instant invention combine the advantages of good storage stability with good washing performance. Moreover, when washing trials were repeated employing washing compositions that omitted the phosphonate and gluconate stabilisers, but were otherwise identical, the washing results were also identical, being within 1% stain removal, i.e. within the limits of reproducibility of the washing tests, indicating that the presence of the phosphonate and gluconate stabiliser had not impaired the washing performance even though they had considerably improved the storage stability of the composition.

EXAMPLES 65 TO 69

Compositions were prepared by the method for Examples 1 to 64 except that the step relating to incorporating builder was omitted. The Avox of the compositions was required after 4 weeks storage at 32° C. and the washing trials were carried out in exactly the same manner as those whose results are summarised in Tables 4 to 6, in hard water having a hardness of 150 ppm as calcium carbonate in a Ca:Mg ratio of 2:1.

The compositions and results are summarised in Table 7 below.

TABLE 7

| Example No | | 65 | 66 | 67 | 68 | 69 |
|---|---|---|---|---|---|---|
| | | Composition weight % | | | | |
| Surfactant | | | | | | |
| | $N_1$ | 30 | 30 | 35 | 25 | 20 |
| | $A_2$ | 5 | 5 | 5 | 10 | |
| Hydrotrope | $HX_2$ | 5 | 5 | 5 | 5 | 5 |
| Ethanol | SE | 10 | 10 | 10 | 10 | 10 |
| Hydrogen Peroxide | | 7 | 7 | 7 | 7 | 7 |
| Gluconate | SG | 0.20 | 0.20 | 0.20 | 0.20 | 0.20 |
| Phosphonate | $SP_1$ | 0.15 | 0.15 | 0.15 | 0.15 | 0.15 |
| Water | | balance | | | | |
| Stability | | | | | | |
| Avox Lost | | 3.9 | 1.8 | 1.8 | 3.4 | 2.2 |
| % Soil Removal | | | | | | |
| Red Wine | 10 Mins | 63 | 63 | 66 | 66 | 68 |
| Red Wine | 30 Mins | 68 | 67 | 72 | 71 | 73 |
| Cocoa | 10 Mins | 10 | 9 | 8 | 9 | 8 |
| Cocoa | 30 Mins | 13 | 11 | 10 | 11 | 11 |

The effectiveness of the soil removal can be judged by comparison with commercially available detergent compositions in the USA, viz WISK and DYNAMO each at 2 gpl, on further examples of the stains under the same conditions of wash temperature, water hardness and wash duration, either alone or in 50:50 weight mix with a bleach additive CLOROX 2.

The comparative results are summarised below in Table 8.

TABLE 8

| | % Soil removal from stain | | | |
|---|---|---|---|---|
| | Red Wine | | Cocoa | |
| | 10 Mins | 30 Mins | 10 Mins | 30 mins |
| WISK | 37 | 40 | 1 | 6 |
| WISK + CLOROX | 44 | 61 | 3 | 6 |
| DYNAMO | 50 | 54 | 5 | 10 |
| DYNAMO + CLOROX | 45 | 62 | 8 | 9 |

From the above it can be seen that the invention compositions obtained significantly better results in the respected red wine stain than did the commercial compositions and in respect of the cocoa stain obtained much better result than did the sample of WISK, alone or with added bleach and comparable with or better than the results obtained using DYNAMO, alone or with added bleach.

EXAMPLES 73–81 AND COMPARISONS 70–72 AND 82/83

Each of Examples 73–80 and Comparisons 70–72 was prepared by first mixing an anionic (ABS-linear $C_{12}$ alkylbenzene sulphonate) and a nonionic (AEO-lower cut primary alcohol ethoxylate (n=9)-ETHYLAN CD919) surfactant, in amounts to give 6% w/w and 4% w/w respectively in the final product, with agitation and heating to about 40°–45° C. when a clear solution was obtained. The sulphonate hydrotrope (ELTESOL SX30, 6%) and any builder as specified in Table 9 were then stirred in with the surfactants, together with a proportion of the deionised water, which cooled the mixture. Next the stabiliser was added, as specified in Table 9, as well the optical brightener (UVITEX BHT, 0.25%). Finally, 35% w/w aqueous hydrogen peroxide solution was stirred in to provide 7% by weight hydrogen peroxide. In Example 81 and Comparisons 82 and 83, the compositions were made following the general method of the Comparisons/Examples 70 to 80, but employing 30% of the said nonionic surfactant, 5% of the said anionic surfactant, 0.25% of the said optical brightener, 7% hydrogen peroxide and stabiliser as shown in Table 9, but no builder or hydrotrope.

In Table 9, the abbreviations 'KTPP' refer to potassium tetrapyrophosphate, added as an aqueous solution, 'SC' to sodium citrate, SGP to a mixture of sodium gluconate and hexapotassium ethylenediaminetetra (methylene phosphonate) in a weight ratio of 4:3 available under the trade name POLYRON 1020, 'Meths' to a commercially available industrial grade ethanol containing a small amount of methanol and IPA to isopropyl alcohol.

The storage stability trials for the Table were effected by transferring a small sample of the selected composition into a clean plastic bottle housed in a constant temperature enclosure at 32° C. The available oxygen concentration (Avox) in the composition was determined by the standard acidified potassium permanganate titration method on a small portion extracted from the sample and the result obtained after storage for a given period compared with the original content. The result shown for Examples 5 and 12 and comparisons 1–4 and 13/14 is the percentage of Avox lost from the hydrogen peroxide after 6 weeks storage, and for Examples 6 to 11, after 8 weeks storage.

TABLE 9

| | Builder | Stabilisers | | | SPG | Avox |
|---|---|---|---|---|---|---|
| | Type | wt % | Alcohol | wt % | wt % | Loss |
| Comp 70 | KTPP | 10 | — | — | 0.35 | 7.1 |
| Comp 71 | " | 10 | Meths | 5 | — | 8.6 |
| Comp 72 | " | 10 | IPA | 5 | — | 9.2 |
| Ex 73 | " | 10 | Meths | 5 | 0.35 | 4.7 |
| Ex 74 | " | 10 | IPA | 5 | 0.35 | 4.0 |
| Ex 75 | SC | 10 | " | 5 | " | 5.2 |
| Ex 76 | " | 10 | " | 10 | " | 7.1 |
| Ex 77 | " | 15 | " | 5 | " | 6.9 |
| Ex 78 | " | 15 | " | 10 | " | 8.1 |
| Ex 79 | KTPP | 10 | " | 5 | " | 5.2 |
| Ex 80 | " | 10 | " | 10 | " | 7.8 |
| Ex 81 | — | — | " | 5 | " | 4.7 |
| Comp 82 | — | — | — | — | " | 6.6 |
| Comp 83 | — | — | IPA | 5 | — | 8.0 |

From Table 9, it can be seen that the stabiliser system comprising meths and SPG performed substantially the same as IPA and SPG.

When the Peskey-Martin closed cup flash point test was carried out on Examples 73 and 74 compositions, the latter was found to be about 15° C. higher, a typical difference, indicating that the IPA-containing compositions were inherently safer. When the two compositions were employed in fabric and stain washing trials by the general method employed in the Examples hereinbefore the results of the two compositions were in essence the same.

EXAMPLE 84

In a modification of Examples 73 and 74, identical compositions were obtained by adding the stabilisers and hydrogen peroxide together as the last step in the form of a premix that had been obtained by first introducing an aqueous SPG solution consisting of sodium gluconate (20% w/w), potassium salt of ethylene diamine tetra(methylene phosphonate) (15% w/w) and water (65% w/w) into respectively either ethanol (methylated spirits) (Ex. 73) or isopropyl alcohol (Ex. 74) in a weight ratio of aqueous SPG solution:alcohol of 1:5, and gradually stirring into that mainly organics component aqueous hydrogen peroxide (50% w/w) in a weight ratio to the organics component of 14:6. This produced compositions containing 35% w/w hydrogen peroxide, 38.25% w/w water and 26.75% w/w organics component in which the weight ratio of alcohol:SPG was 14.3:1. The premix was used in the ratio of 20 parts by weight per 80 parts of the other components, including water.

EXAMPLE 85

In a similar modification, the composition of Example 50 is obtained by employing the procedure followed in Example 84, except that the weight ratio of ethanol:said aqueous SPG solution was 10:1, and that of organics component to aqueous hydrogen peroxide (50 w/w) was 11:14. This produced a premix composition containing 28% hydrogen peroxide, 30.6% water and 41.4% organics component having a weight ratio of alcohol to SPG of 28.6:1. Dilution and augmentation of 25 parts by weight of this premix was 75 parts by weight of the other components (including water) specified in respect of Example 50 herein produces that composition.

We claim:

1. A stabilised aqueous built alkaline liquid detergent composition comprising at least 4% of an anionic sulphate or sulphonate surfactant and/or of a non-ionic ethoxylate surfactant, at least 5% of a builder selected from alkali metal polyphosphates and carboxylic complexing builders, at least 2% hydrogen peroxide, sufficient alkali metal aryl sulphonate hydrotrope to maintain the composition in a single phase, either by itself or in conjunction with other components, and a stabilising amount of a combination comprising, from 5 to 15% of a low molecular weight mono-hydroxy saturated aliphatic alcohol, from 0.08 to 1% of a polyhydroxy aliphatic carboxylate and from 0.075–1% of an aminomethylene phosphonate or hydroxyalkyl diphosphonate, %'s being by weight, based on the weight of the composition.

2. A composition according to claim 1 wherein the proportion of anionic sulphate or sulphonate surfactant is selected within the range of 3 to 15% weight.

3. A composition according to claim 1 wherein the proportion of nonionic alcohol ethoxylate is selected within the range of 3 to 15% by weight.

4. A composition according to claim 1 wherein the weight proportion of ethoxylate in the nonionic alcohol ethoxylate is from 60 to 80% of the molecule.

5. A composition according to claim 1 wherein the total proportion of anionic sulphate or sulphonate and nonionic alcohol ethoxylate surfactants is from 6 to 15%.

6. A composition according to claim 1 wherein the weight ratio of anionic sulphate or sulphonate surfactant to nonionic alcohol ethoxylate surfactant is from 5:2 to 2:5.

7. A composition according to claim 1, 5 or 6 wherein the builder comprises a polyphosphate or an hydroxy carboxylic acid complexing builder.

8. A composition according to claim 7 wherein the proportion of builder is selected within the range 9 to 16% by weight.

9. A composition according to claim 7 wherein the polyphosphate comprises potassium tetra pyrophosphate.

10. A composition according to claim 7 wherein the builder comprises an alkali metal citrate.

11. A composition according to any of claims 1, 5 or 6 wherein the builder comprises up to 10% nitrilotriacetic acid, alkali metal salt or up to 8% carboxymethylsuccinate, alkali metal salt.

12. A composition according to claim 1, wherein the total proportion of all components except for water and hydrogen peroxide is from 30 to 45% by weight.

13. An unbuilt aqueous alkaline liquid detergent composition comprising at least 10% of an anionic surfactant and/or of a non-ionic ethoxylate surfactant, of which at least 5% is nonionic surfactant, at least 2% hydrogen peroxide, sufficient alkali metal aryl sulphonate hydrotrope to maintain the composition in a single phase, either by itself or in conjunction with other components, and a stabilising amount of a combination comprising from 5 to 15% of a low molecular weight mono-hydroxy saturated aliphatic alcohol, from 0.08–1% of a polyhydroxy aliphatic carboxylate and from 0.075–1% of an aminomethylene phosphonate or hydroxyalkyl, based on the weight of the composition.

14. A composition according to claim 13 wherein the proportion of anionic sulphate or sulphonate surfactant is selected within the range of 3 to 15% weight.

15. A composition according to claim 13 wherein the proportion of nonionic alcohol ethoxylate is selected within the range of 5 to 35% by weight.

16. A composition according to claim 13 wherein the weight proportion of ethoxylate in the nonionic alcohol ethoxylate is from 60 to 80% of the molecule.

17. A composition according to claim 13 wherein the total proportion of anionic sulphate or sulphonate and nonionic alcohol ethoxylate surfactants is from 6 to 40%.

18. A composition according to claim 13 or 17 wherein the weight ratio of anionic sulphate or sulphonate surfactant to nonionic alcohol ethoxylate surfactant is from 1:3 to 1:6.

19. A composition according to claim 13 wherein the total proportion of all components except for water and hydrogen peroxide is from 40 to 55% by weight.

20. A composition according to claim 1 or 13 wherein the proportion of hydrogen peroxide is selected within the range 5 to 15% by weight.

21. A composition according to claim 1 or 13 wherein the proportion of sulphonate hydrotrope is selected within the range 3 to 9% by weight.

22. A composition according to claim 1 or 13 which contains from 1 to 3% by weight of an ethoxylated phosphate ester.

23. A composition according to claim 1 or 13 wherein the weight ratio of the polyhydroxy carboxylate to the phosphonate is from 2:1 to 1:1.

24. A composition according to claim 1 or 13 wherein the low molecular weight aliphatic alcohol comprises ethanol or isopropanol or a mixture thereof.

25. A composition according to claim 24 wherein the alcohol comprises methylated spirits.

26. A composition acording to claim 1 or 13 wherein the proportion of polyhydroxy carboxylate is from 0.1 to 0.4% by weight.

27. A composition according to claim 1 or 13 wherein the polyhydroxy carboxylate comprises an alkali metal gluconate.

28. A composition according to claim 1 or 13 wherein the proportion of phosphonate is selected within the range of 0.1–0.4% by weight.

29. A composition according to claim 28 wherein the phosphonate comprises an ethylene diamine tetra(methylene phosphonic acid) or hexamethylene diamine tetra(methylene phosphonic acid) or diethylene triamine penta(methylene phosphonic acid) or an alkali metal salt thereof.

30. A composition according to claim 1 or 13 which contains from 5 to 12% by weight ethanol or isopropanol or a mixture thereof.

31. A built liquid detergent composition which comprises from 8 to 12% in total of anionic sulphate or sulphonate surfactant and nonionic ethoxylated surfactants, from 9 to 15% builder selected from alkali metal, tetra pyrophosphate or alkali metal citrate from 3 to 9% alkali metal aryl sulphonate hydrotrope; from 5 to 12%, ethanol or isoproponal; from 5 to 10%, hydrogen peroxide; from 0.2 to 1% in total of a polyhydroxy linear $C_6$ or $C_7$ aliphatic carboxylate, and an alkali metal amino methylene phosphonate complexing agent, up to 5% of detergent adjuvant or adjuvants and the balance, water, %s being by weight.

32. A composition according to claim 31 characterised by one or more of the following features:

(i) from 3 to 8% of the surfactant is anionic and 2 to 8% is nonionic;

(ii) the builder is selected from potassium tetrapyrophosphate and sodium citrate;

(iii) from 8 to 12% ethanol or isopropanol is used;

(iv) the aliphatic carboxylate is an alkali metal gluconate;

(v) the phosphonate complexing agent comprises an ethylene diamine tetramethylene phosphonate, hexamethylene diamine tetramethylene phosphonate or diethylene triamine pentamethylene phosphonate;

(vi) the aliphatic carboxylate and phosphonate complexing agent are in a weight ratio of 2:1 to 1:1;

(vii) the water content is from 55 to 65%.

33. An unbuilt liquid detergent composition which comprises from 25 to 40% in total of anionic sulphate or sulphonate surfactant and nonionic ethoxylated surfactants, from 3 to 9% alkali metal aryl sulphonate hydrotrope; from 5 to 12% ethanol or isoproponal; from 5 to 10% hydrogen peroxide; from 0.2 to 1% in total of a polyhydroxy linear $C_6$ or $C_7$ aliphatic carboxylate, and an alkali metal methylene phosphonate complexing agent, up to 5% of detergent adjuvant or adjuvants and the balance, water, %s being by weight.

34. A composition according to claim 33 characterised by one or more of the following features:

(i) from 3 to 8% of the surfactant is anionic and 20 to 35% is nonionic;

(ii) from 8 to 12% ethanol or isopropanol is used;

(iii) the aliphatic carboxylate comprises an alkali metal gluconate;

(iv) the phosphonate complexing agent comprises an ethylene diamine tetramethylene phosphonate, hexamethylene diamine tetramethylene phosphonate or diethylene triamine pentamethylene phosphonate;

(v) the aliphatic carboxylate and phosphonate complexing agent are in a weight ratio of 2:1 to 1:1;

(vi) the water content is from 40 to 60%.

35. A composition according to any one of claims 1, 13, 31, or 33 in which the hydrogen peroxide and the stabilisers have been introduced by incorporation of the corresponding amount of a premix consisting essentially of:

(a) from 20 to 35% by weight, based on the composition, of hydrogen peroxide, (b) water in an amount of at least 3 parts per 7 parts by weight of hydrogen peroxide and (c) an organics component comprising a mixture of stabiliser in a weight ratio to the hydrogen peroxide of from 1:4 to 3:1 and comprising a low molecular weight monohydric aliphatic alcohol and an aminomethylenephosphonate and an hydroxyalkyldiphosphonate optionally together with up to thrice its weight of a polyhydroxycarboxylate to a total weight ratio to the monohydric alcohol of from 1:4.5 to 1:60.

36. A process for the production of a detergent composition according to claim 1 wherein the components are mixed until an homogenous mixture is obtained, the order of introduction of the components being such that the hydrogen peroxide contacts the polyphosphate or surfactants only in the presence of the stabiliser system.

37. A process for washing or laundering comprising the steps of diluting a composition as described in any of claims 1, 13, 31 or 33 to a desired extent and contacting the article to be washed with the dilute solution at a temperature from ambient to the boiling point of the solution.

38. A process for stabilising hydrogen peroxide in an aqueous detergent composition comprising at least 4% of an anionic surfactant and/or of a non-ionic ethoxylate surfactant, up to 20% of a builder selected from alkali metal polyphosphates and carboxylic complexing builders, at least 2% hydrogen peroxide, sufficient alkali metal aryl sulphonate hydrotrope to maintain the composition in a single phase, either by itself or in conjunction with other components, characterised by incorporating in the composition a stabilising amount of a combination comprising a low molecular weight monohydroxy aliphatic alcohol, a polyhydroxy aliphatic carboxylate and an aminomethylene phosphonate or hydroxyalkyl diphosphonate, %'s being by weight.

39. A process according to claim 38 wherein the combination incorporated in the composition comprises 5 to 15% ethanol and/or isopropanol, and 0.1 to 0.4% of each of the polyhydroxyaliphatic carboxylate and the aminomethylenephosphonate.

40. A composition according to claim 1 wherein the total amount of carboxylate and phosphonate is from 0.2 to 1% and wherein the weight ratio of carboxylate:-phosphonate is from 1:3 to 3:1.

41. A composition according to claim 13 wherein the total amount of carboxylate and phosphonate is from 0.2 to 1% and wherein the weight ratio of carboxylate:-phosphonate is from 1:3 to 3:1.

* * * * *